United States Patent [19]

Griffiths

[11] 4,228,736

[45] Oct. 21, 1980

[54] PRINTING APPARATUS

[76] Inventor: John B. Griffiths, 38, Charleville Rd., London, England, W14 9JH

[21] Appl. No.: 929,016

[22] Filed: Jul. 28, 1978

[51] Int. Cl.[3] ..... B41K 1/08

[52] U.S. Cl. ..... 101/382 MV

[58] Field of Search ..... 101/382 MV, 382 R, 377, 101/368

[56] References Cited

U.S. PATENT DOCUMENTS

| | | | |
|---|---|---|---|
| 1,001,689 | 8/1911 | Rogers | 101/382 MV |
| 1,518,727 | 12/1924 | Bornstein | 101/382 MV |
| 2,575,772 | 11/1951 | Schenker | 101/368 |
| 2,620,731 | 9/1952 | Slanneger | 101/382 MV |
| 2,673,518 | 3/1954 | Ardizzone | 101/382 MV |
| 3,703,142 | 11/1972 | Mimlitch | 101/382 MV |
| 3,724,370 | 4/1973 | Martin | 101/377 |
| 3,857,224 | 12/1974 | Hewitt | 101/382 MV |

FOREIGN PATENT DOCUMENTS

| | | | |
|---|---|---|---|
| 1003424 | 3/1952 | France | 101/382 R |
| 1505548 | 3/1978 | United Kingdom | 101/382 MV |

*Primary Examiner*—William Pieprz

[57] ABSTRACT

A printing apparatus has a holder which incorporates a permanent magnet and has a printing element or elements containing magnetically soft material.

In use a printing element is held against a thin positioning portion by the attraction of the permanent magnet. To engage a printing element the printing element is placed in contact with the positioning portion and the permanent magnet is brought up to the positioning portion. To release a printing element the permanent magnet is moved away from the positioning portion.

Printing elements may be aligned printing-face down in an aligning member. The printing elements have depicted on the face opposite the printing surface the character on the printing surface.

In one version a printing apparatus is used as a hand-stamp, and in another version a printing apparatus is inked and used by hand-rolling.

3 Claims, 10 Drawing Figures

PRINTING APPARATUS

This invention relates to manually operable printing apparatus, and printing elements therefor.

It is an object of the present invention to provide printing apparatus which is manually operable and inexpensive and simple to use so that for example young children may use the apparatus.

The present invention provides printing apparatus comprising one or more printing elements having a printing surface and containing magnetically soft material, and a holder for the printing element or elements including a permanently magnetised portion so that a printing element can be held by magnetic attraction to the holder.

The printing elements may be formed entirely of magnetically soft material, for example ferrite, or an elastomer containing magnetically soft particles. The printing elements may be solid figures or symbols but as preferred a design to be printed is merely provided in relief on the printing surface.

As preferred a printing element comprises a layer of elastomer (for example, natural rubber) bearing the printing surface, and a layer of magnetically soft material backing the printing surface. The layer of magnetically soft material preferably comprises an elastomer containing magnetically soft particles.

The printing elements may bear on the opposite side to the printing surface, impressed or printed, a depiction of the design as an aid in assembling type.

The holder may include a positioning portion on which an element can be positioned, the positioning portion and the magnet being relatively movable between one position in which said element is held and another position in which said element is released.

The positioning portion may be such as to position said element in a predetermined position. An aligning member may be provided on which a printing element or elements may be arranged prior to being held by said holder.

Said permanently magnetised portion may be one or more strips with opposite poles extending along opposite edges of each strip, or a block with parallel rows of poles on a surface, the spacing between the poles being substantially equal to a dimension of an element.

Preferably a positioning portion comprises an integral number of shaped channels so that a row or rows of printing elements may be held.

Preferably a positioning portion comprises a shaped area to accomodate one printing element so that a single printing element will be located on the holder.

Preferably a permanently magnetised portion is disposed on a carrier so that the permanently magnetised portion may easily be moved.

Preferably a permanently magnetised portion is enclosed so that the magnet does not pick up material.

Preferably a permanently magnetised portion and a positioning portion are hingedly connected along one edge to facilitate block printing.

Preferably a printing element comprises an elastomer containing magnetically soft particles so that the printing element is both held by the permanently magnetised portion and also is suitable for printing.

Preferably a printing element comprises a layer of elastomer bearing a printing surface and a backing layer comprising magnetically soft material so that a printing element may be held by the holder and is also suitable for printing.

Preferably a backing layer comprises an elastomer containing magnetically soft particles as this is an efficient way of producing a printing element.

Preferably a printing element has a depiction of the design to be printed on the face opposite the printing surface to simplify arranging the printing elements in an aligning member.

Preferably at least one north pole and one south pole run longitudinally along each channel so that the printing elements may be held firmly.

Preferably an aligning member is used so that printing elements may be arranged prior to being held by the holder.

Preferred embodiments of the invention will now be described with reference to the accompanying drawings wherein.

Figure 1:
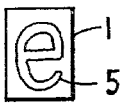
FIGS. 1 to 4 are a plan view, bottom view and side sectional views of a preferred printing element.
Figure 2:
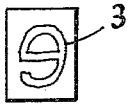
Figure 3:
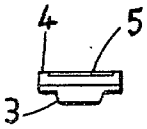
Figure 4:
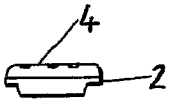
Figure 5:
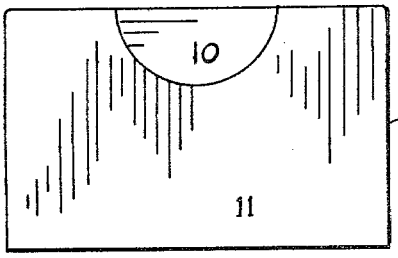
FIGS. 5 and 6 are a front view and plan view of a preferred holder with a positioning portion having a channel.
Figure 8:
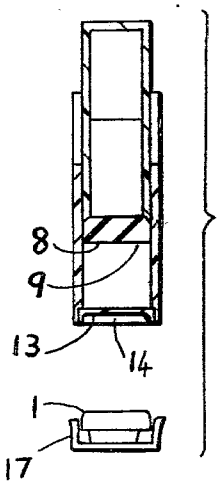
FIG. 8 is a cross-sectional side view through the centre of the preferred single channel holder 'being supported by the carrier' and includes a printing element and aligning member.
Figure 6:
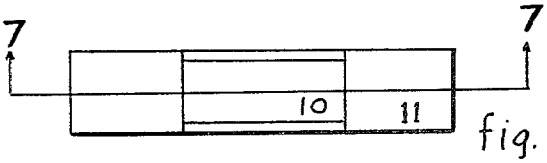

Referring to FIGS. 1 to 4, a preferred printing element (1) comprises two layers of material bonded together. A printing layer (2) of natural rubber is 1 mm thick and bears a reverse relief design (3) which projects 1 mm from the body of the printing block. A backing layer (4) comprises magnetically soft material comprising 80% of weight iron dust. (Carbonyl Iron powder, average diameter 5 microns) in a matrix of thermoplastics rubber (Styrene-Butadiene-Styrene block copolymers). The backing layer is 1.5 mm thick and has impressed on its exposed surface to a depth of 0.2 mm a depiction (5) of the design (3) on that printing element. The exposed edges of the backing layer on the sides corresponding to the top and bottom of a design are rounded with a radius of 1.5 mm. The printing element is 12 mm long and of a width according to the design on that printing element. The printing elements are formed in strips 12 mm wide and 20 cm long comprising several different designs. A strip comprising the backing layer is formed from calendered sheet by compression moulding. Another strip comprising the printing layer is formed from natural rubber by compression moulding and curing. The corresponding backing and printing strips are then bonded together using a suitable adhesive. The individual printing elements are cut from the two layer bonded strip.

A printing outfit would contain perhaps 100 printing elements, formed by cutting three different strips of printing elements.

A preferred single channel holder (6) according to this invention is shown in FIGS. 5–8.

The holder (6) is constructed from moulded poly-carbonate plastics parts and a permanently magnetised portion comprising a strip of magnetic rubber. The strip of magnetic rubber (7) is 7 cm long, 11.1 mm wide and 4.6 mm high. The magnetic rubber comprises a magnetically hard ferrite distributed in a thermoplastics elastomer matrix. The strip is permanently magnetised with North (8) and South (9) poles running continuously along either side of the lower face of the strip.

The magnetic strip is bonded to a carrier (10) which is free to slide over a limited vertical range inside the body (11) of the holder. There is a recessed step (12) running around the lower internal edges of the body (11). The step (12) is to accommodate a positioning portion or base plate (13) which is cemented in place after the carrier and magnetic strip have been placed inside the body. There is a channel (14) formed on the lower surface of the base plate to accommodate the upper surfaces of printing elements. The channel matches the curvature of the printing elements, and the central portion of the base plate is only 0.5 mm thick. The surface of the channel is rough with 20μ irregularities.

The carrier (10) and magnet (7) assembly are free to slide vertically between two limits. At the lower limit the magnetic strip rests against the base plate. At the upper limit the shoulder (15) of the carrier lies against the top (16) of the body. The magnet is effectively enclosed to prevent stray material adhering to the magnet.

In use printing elements (1) are arranged with their depictions (5) uppermost along an aligning member (17). The aligning member is a piece of plastics material channel having the same length as the channel (14). The holder (6) is held by the carrier (10) so that the body drops with respect to the carrier. The holder is then lowered onto the printing elements in the aligning member so that the channel (14) fits over the printing elements. The carrier is allowed to drop and the holder is then picked up by the body (11). To release the printing elements the carrier (10) is lifted with respect to the body (11).

The printing outfit also includes a tray for holding printing elements and an inking pad.

Figure 9:
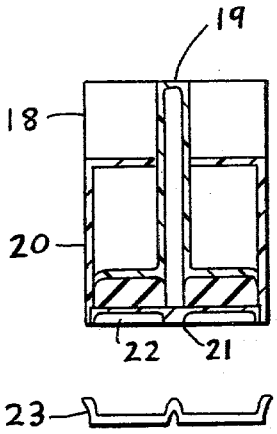
FIG. 9 is a cross-sectional side view of a double channel holder, with a double channel aligning member.
Figure 7:
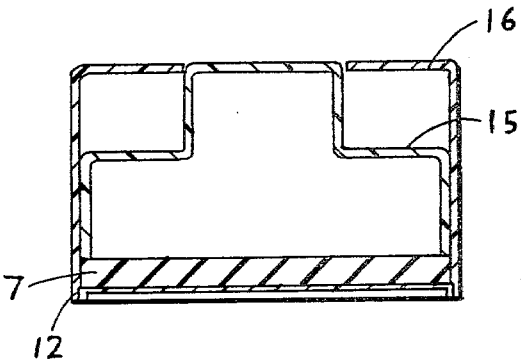
FIG. 7 is a cross-sectional view of FIG. 6 through the line 7—7.

A preferred double channel holder (18) is shown in FIG. 9. This is similar in many respects to the holder (6) except that the carrier (19) carries two strips of magnetic rubber. The body (20) is wider to accommodate the two strips and the guard portion base plate (21) has two channels (22). The magnetic strips are separated by a 3 mm gap and there is a corresponding gap between the channels. The magnetic strips are arranged so similar poles are adjacent, and both the poles near the centre would be North poles. The double channel holder is designed to use the same printing elements as the single channel holder. A double channel aligning member (23) is used in conjunction with the holder (19).

Figure 10:
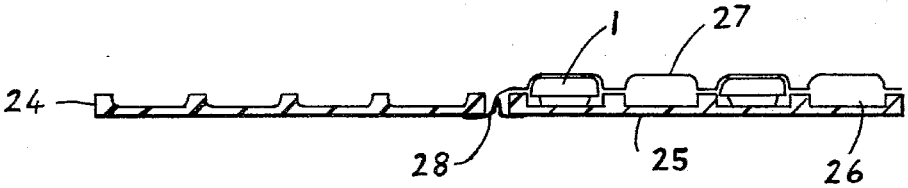
FIG. 10 is a cross-sectional side view of a holder using a shaped magnetic slab.

Referring to FIG. 10, another preferred embodiment, a permanently magnetised portion consists of a shaped slab (24) of magnetic rubber. The shaped slab is extruded so that there are a series of channels each of which corresponds to the rounded back of a preferred printing element. The slab is magnetised so that alternate raised portions between channels are North poles, the remaining raised portions being South poles. An aligning member (25) has trays (26) with the same spacing as the channels on the slab. A thin flexible guarding portion (27) is shaped to fit into the channels of the slab. The shaped slab, the flexible guarding portion and the aligning member are joined by a cloth hinge (28) so that the guarding portion can be moved from a position where it fits over printing elements in the aligning member to another position where it fits snugly over the shaped slab.

In use printing elements are arranged on the aligning member and the flexible positioning portion is placed over them. Then the shaped magnetic slab is lowered over the positioning portion. The shaped magnetic slab, positioning portion and printing elements are lifted away from the aligning frame and may be inked for printing.

In another preferred embodiment printing elements are cast from polysolphide rubber containing 80% by weight iron dust, using a catalyst.

What is claimed is:

1. Printing apparatus comprising, a set of printing elements, each printing element bearing a printing surface and containing magnetically soft material, each printing element of the said set having substantially the same height and thickness as each other, each printing element having on the surface opposite the printing surface a depiction of the design to be printed, a holder including a permanently magnetised portion with poles and a relatively moveable positioning portion, said positioning portion bearing an integral number of channels and covering at least one pole of the permanently magnetised portion, a said channel being shaped such that printing elements arranged side by side fit against the channel with their printing surfaces proud of positioning portion, the positioning portion being movable between two positions, a first printing element holding position in which said permanently magnetized portion is positioned adjacent said channels of said channels of said positioning portion to magnetically hold said printing elements, and a second printing element releasing position in which the permanently magnetized portion is moved a distance from the channel of said positioning portion sufficient to release the printing elements from the hold of the permanently magnetized portion, and an aligning means, comprising a number of aligning channels along which printing elements locate slideably, side by side, with said depictions exposed, the printing apparatus being such that printing elements are set in the holder by placing printing elements on the aligning means, fitting the positioning portion over the printing elements and moving the permanently magnetised portion relative to the positioning portion to said first position in which printing elements are held magnetically against the positioning portion, printing elements being released from the holder back to the aligning means by locating the holder with attached printing elements on the aligning means and moving the permanently magnetised portion relative to the positioning portion to a second position in which the printing elements are not held magnetically against the positioning portion.

2. A printing apparatus as claimed in claim 1 wherein said positioning portion is held against the permanently magnetised portion by the magnetic attraction acting on the printing elements.

3. A printing apparatus as claimed in claim 1 wherein the positioning portion is flexible and hingedly moveable relative to said permanently magnetised portion.

* * * * *